United States Patent [19]

May et al.

[11] Patent Number: 4,476,030

[45] Date of Patent: Oct. 9, 1984

[54] CONCENTRATED SOFTENER MASTERBATCHES

[75] Inventors: Adolf May, Hofheim am Taunus; Hans-Walter Bücking, Kelkheim; Manfred Schreiber, Frankfurt am Main, all of Fed. Rep. of Germany

[73] Assignee: Hoechst Aktiengesellschaft, Fed. Rep. of Germany

[21] Appl. No.: 448,305

[22] Filed: Dec. 9, 1982

[30] Foreign Application Priority Data

Dec. 18, 1981 [DE] Fed. Rep. of Germany ..... 3150179

[51] Int. Cl.[3] ..... D06M 13/16; D06M 13/02; D06M 13/20; D06M 13/38

[52] U.S. Cl. ..... 252/8.8

[58] Field of Search ..... 252/8.8

[56] References Cited

FOREIGN PATENT DOCUMENTS 0013780 8/1980 European Pat. Off. ..... 252/8.8
0018039 10/1980 European Pat. Off. ..... 252/8.8
0056695 7/1982 European Pat. Off. ..... 252/8.8

*Primary Examiner*—Maria Parrish Tungol
*Attorney, Agent, or Firm*—Connolly & Hutz

[57] ABSTRACT

Concentrated masterbatches of fabric softeners consisting substantially of (a) from 20 to 70, weight % of one or more compounds of the formulae I to III,

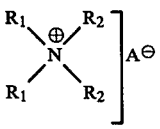

(I)

-continued

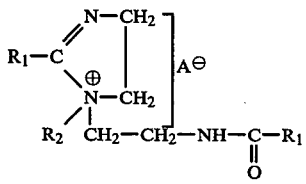

(II)

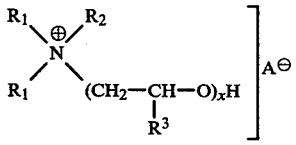

(III)

in which $R_1$ is alkyl or alkenyl having from 8 to 22, carbon atoms, $R_2$ is alkyl having from 1 to 4 carbon atoms, $R_3$ is methyl or hydrogen, x is a number of from 1 to 5 and A is an anion (b) from 20 to 60, weight % of a paraffin, a fatty alcohol, a fatty acid, a fatty acid-$C_1$–$C_{13}$-alkyl ester, each having from 8 to 22, carbon atoms, a polyethyleneglycol having a molecular weight of from 200 to 600, an alkyl ester having from 8 to 22, carbon atoms of a polyethyleneglycol having a molecular weight of from 200 to 600 or a polypropyleneglycol having a molecular weight of from 200 to 1,000 or mixtures thereof, (c) from 5 to 25 weight % of an amino-oxethylate of the formula

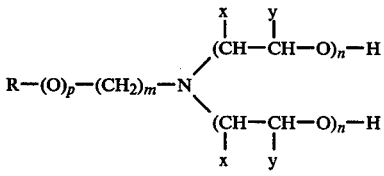

(IV)

in which $R_1$ is alkyl or alkenyl having from 8 to 22, carbon atoms, x and y are hydrogen or methyl, with the proviso that x and y are not simultaneously methyl, n is an integer of from 2 to 40, preferably 10, p is a number of from zero to 1 and m is a number of from zero to 3, with the provisio that in case of p being 1 m is preferably 3, and water up to 100%.

4 Claims, No Drawings

CONCENTRATED SOFTENER MASTERBATCHES

It is known that textiles which have been washed, especially in an automatic washer, and particularly those made from cellulose fibers, are in an unpleasant hardened state after drying. This undesirably hardened feel can be overcome by treating the textiles after washing in a rinsing bath with cationic substances which contain at least two long-chain aliphatic radicals in the molecule. Especially the dialkyldimethylammonium salts or imidazole derivates of the formulae I to III

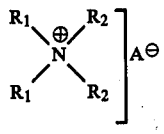

(I)

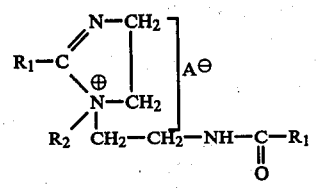

(II)

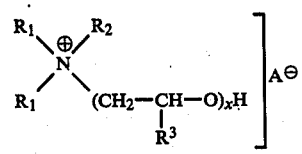

(III)

are used in the practice for this purpose.

In these formulae, $R_1$ is alkyl or alkenyl having from 8 to 22, preferably 10 to 18, carbon atoms, $R_2$ is alkyl having from 1 to 4 carbon atoms, preferably methyl, $R_3$ is methyl or hydrogen, x is a number of from 1 to 5 and A is an anion such as $Cl^{(-)}$, $Br^{(-)}$, $CH_3OSO_3^{(-)}$ or $CH_3OPO_3^{(-)}$.

Depending on the alkyl radical $R_1$, the products of the formulae I to III are liquid or solid. In the case of $R_1$ being a saturated radical the product is solid at room temperature. It is transported in heated tank trucks or railway tank wagons, while it is shipped overseas in barrels. The manufacturers of fabric softeners generally store then the products in heatable tank equipment. When the raw material is to be processed, the product so stored in warm state is dispersed in hot water. In the case where the product is to be processed directly from the barrel, it has to be liquefied first by means of barrel heating equipment before it can be properly treated.

On the other hand, in the case where the alkyl radicals of the compounds I to III are saturated moieties, these derivatives are liquid at room temperature, and they can be processed to dispersions by means of cold water. However, as compared to the saturated derivatives, liquid raw materials for fabric softeners have a reduced softening effect. In order to attain a comparable feel, considerably more cationic substance must be applied to the fabric in this case. Thus, 1 kg of the compounds of formulae I to III having saturated radicals $R_1$ corresponds to 1.33 kg of the same compounds having an unsaturated radical $R_1$.

Therefore, compounds of the formula I to III having saturated alkyl groups are preferred which, however, have the above disadvantages for the manufacturer of ready-to-use fabric softeners. In order to avoid these drawbacks, it is the object of the producer of he cited quaternary ammonium compounds to provide these compounds in such a form which allows the processing industry to omit heating or liquefaction of these raw materials. This object is achieved by supplying the quaternary ammonium compounds in the form of a highly concentrated liquid formulation called masterbatch. However, such highly concentrated formulations cannot be prepared by using water alone, for, merely solutions having a very low content of active substance are thus obtained. It has now been found that a considerably higher concentration is attained by combining the quaternary ammonium compounds with a liquid fatty amine oxethylate, furthermore a paraffin, a fatty alcohol, a fatty acid, a fatty acid ester, a polyglycol or a polyglycolic acid ester, or mixtures thereof. Subject of the invention are therefore concentrated masterbatches of fabric softeners consisting substantially of (a) from 20 to 70, preferably 35 to 45, weight % of one or more compounds of the above formulae I to III, (b) from 20 to 60, preferably 40 to 60, weight % of a paraffin, a fatty alcohol, a fatty acid, and a fatty acid-$C_1$-$C_{13}$-alkyl ester, each having from 8 to 22, preferably 16 to 18, carbon atoms, a polyethyleneglycol having a molecular weight of from 200 to 600, an alkyl ester having from 8 to 22, preferably 14 to 16, carbon atoms of a polyethyleneglycol having a molecular weight of from 200 to 600 or a polypropyleneglycol having a molecular weight of from 200 to 1,000, (c) from 5 to 25 weight % of an amino-oxethylate of the formula

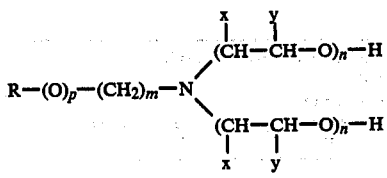

(IV)

in which $R_1$ is alkyl or alkenyl having from 8 to 22, preferably 16 to 18, carbon atoms, x and y are hydrogen or methyl, with the proviso that x and y are not simultaneously methyl, n is an integer of from 2 to 40, preferably 10, p is a number of from zero to 1, preferably zero and m is a number of from zero to 3, with the provisio that in case of p being 1 m is preferably 3, and water up to 100%.

Suitable components (b) are for example commercial paraffins in the $C_8$-$C_{22}$, preferably $C_{13}$-$C_{18}$, range, fatty alcohols such as oleyl alcohol, fatty acids such as isostearic acid, fatty acid esters such as butyl stearate, 2-ethyl stearate, iso-tridecyl stearate, polyglycol-400-monolaurate, polyglycol-400-monostearate, polyglycols having a molecular weight of from 200 to 600 or polypropylenglycols having a molecular weight of from 200 to 1,000. These auxiliary softeners (b) can be used either alone or in mixtures with one another.

The masterbatches of the invention may contain furthermore other substances and auxiliaries such as cationic or nonionic surface-active compounds, solubilizers, for example p-cumene sulfonate, electrolytes, acidifiers, for example phosphoric or acetic acid, organic complexing agents, optical brighteners, dyestuffs or perfumes. They serve for additionally influencing the feel or other properties or the textiles to be treated, of for adjusting the viscosity or the pH, or for increasing the stability to low temperatures.

These concentrated masterbatches are prepared by simply mixing the individual components in water in the ratio as indicated, thus obtaining solutions or dispersions being liquid at room temperature, which can be transported without heating and stored in tanks under normal conditions.

For the manufacture of commercial fabric softeners containing from about 4 to 8% of active substance, these masterbatches are simply diluted with water. Using a correspondingly smaller amount of water, 3-fold, 4-fold, 6-fold or 8-fold concentrates are obtained. The fabric softeners are applied as usual by adding them to the last rinsing bath after the washing of the textiles, and subsequently drying the goods.

In the following Examples, some softener masterbatches of the invention are described; percentages being by weight in all cases. These masterbatches are prepared in all cases by simply mixing the individual liquid components in cold state.

EXAMPLE 1

| | |
|---|---|
| distearyl-dimethylammonium chloride | 40% |
| paraffin $C_{13}$–$C_{17}$ | 45% |
| oleylamine + 2 EO | 15% |
| appearance at room temperature: liquid, turbid | |
| viscosity: 700 mPas | |

EXAMPLE 2

| | |
|---|---|
| distearyl-dimethylammonium chloride | 50% |
| polyglycol 400 | 36% |
| oleylamine + 2 EO | 14% |
| appearance at room temperature: liquid, turbid | |
| viscosity: 650 mPas | |

EXAMPLE 3

| | |
|---|---|
| distearyl-fatty alkyl-imidazolinium methosulfate | 40% |
| oleyl alcohol | 45% |
| tallon fatty amine + 2 EO | 15% |
| appearance at room temperature: liquid, turbid | |
| viscosity: 700 mPas | |

EXAMPLE 4

| | |
|---|---|
| distearyl-dimethylammonium chloride | 45% |
| butyl stearate | 40% |
| $C_{12}$–$C_{14}$-ether amine + 2 EO | 15% |
| appearance at room temperature: liquid | |
| viscosity: 700 mPas | |

EXAMPLE 5

| | |
|---|---|
| distearyl-dimethylammonium chloride | 70% |
| iso-stearyl alcohol | 20% |
| stearylamine + 8 EO | 10% |
| appearance at room temperature: liquid | |
| viscosity: 600 mPas | |

EXAMPLE 6

| | |
|---|---|
| distearyl-dimethylammonium chloride | 50% |
| polypropyleneglycol 700 | 40% |
| oleylamine + 2 EO | 10% |

EXAMPLE 7

| | |
|---|---|
| distearyl-dimethylammonium chloride | 40% |
| polyglycol-400-monolaurate | 50% |
| oleylamine + 2 EO | 10% |

By addition of water, emulsifiers, acids, liquefying agents, commercial fabric softeners containing about 5 to 8% of softening substance can be produced from the above Examples. As emulsifiers, usual substances such as nonionic surfactants of the nonylphenol oxethylate or alcohol oxethylate type can be used. Alternatively, concentrated softeners such as 3-fold, 4-fold or 6-fold concentrates may be manufactured without any difficulty.

The following Examples describe some ready-to-use fabric softeners in the form of so-called 3-fold concentrates which are prepared from the above masterbatches.

EXAMPLE 8

20 g of the masterbatch of Example 1 were mixed with 0.9 g of perfume and 0.5 g of a nonionic emulsifier of the nonylphenol+10 EO type. Separately, 0.5 g of sodium-paracumene sulfonate (40%) and 8 ml of 1N $H_3PO_4$ were dissolved in 70.10 ml of cold water. This solution was stirred into the above mixture. A stable emulsion having a viscosity of about 100 mPas was obtained.

EXAMPLE 9

25 g of the masterbatch of Example 2 were mixed with 0.9 g of perfume and 1 g of a nonionic emulsifier of the isotridecyl alcohol with 10 EO type. 5 ml of a 10% $CaCl_2$ solution was added to 61.4 ml of cold water, and this solution was stirred into the above mixture. A stable emulsion having a viscosity of about 150 mPas was obtained.

In the same manner as indicated in Examples 8 and 9, the following fabric softeners were prepared:

EXAMPLE 10

| | |
|---|---|
| Masterbatch of Example 3 | 20% |
| $C_{12}$–$C_{15}$-alcohol + 10 EO | 1% |
| perfume | 0.9% |
| $CaCl_2$ solution (10%) | 8% |
| $H_3PO_4$ (1 m) | 6.7% |
| water | to 100% |

EXAMPLE 11

| | |
|---|---|
| Masterbatch of Example 4 | 25% |
| nonylphenol + 9 EO | 1% |
| perfume | 0.9% |
| $CaCl_2$ solution (10%) | 7.5% |
| $H_3PO_4$ (1 m) | 6.7% |
| water | to 100% |

EXAMPLE 12

| | |
|---|---|
| Masterbatch of Example 5 | 23% |
| nonylphenol + 10 EO | 0.5% |
| perfume | 0.8% |
| $M_gCl_2$ solution (10%) | |
| $H_3PO_4$ (1 m) | 6.7% |
| water | to 100% |

EXAMPLE 13

| | |
|---|---|
| Masterbatch of Example 6 | 20% |
| nonylphenol + 10 EO | 1% |
| perfume | 0.9% |
| $CaCl_2$ solution (10%) | 6.5% |
| $H_3PO_4$ (1 m) | 5.4% |
| water | to 100% |

EXAMPLE 14

| | |
|---|---|
| Masterbatch of Example 7 | 28% |
| nonylphenol + 9 EO | 1% |
| perfume | 0.9% |
| $CaCl_2$ solution (10%) | 5% |
| $H_3PO_4$ (1 m) | 6.2% |
| water | to 100% |

What is claimed is:

1. Concentrated masterbatches of fabric softeners consisting substantially of (a) from 20 to 70 weight % of one or more compounds of the formulae I to III,

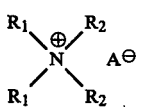

(I)

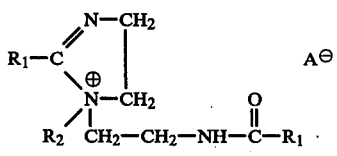

(II)

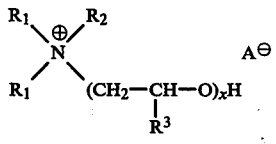

(III)

in which $R_1$ is alkyl or alkenyl having from 8 to 22, carbon atoms, $R_2$ is alkyl having from 1 to 4 carbon atoms, $R_3$ is methyl or hydrogen, x is a number of from 1 to 5 and A is an anion, (b) from 20 to 60 weight % of a paraffin, a fatty alcohol, a fatty acid, a fatty acid -$C_1$–$C_{13}$-alkyl ester, each having from 8 to 22, carbon atoms, a polyethyleneglycol having a molecular weight of from 200 to 600, an alkyl ester having from 8 to 22 carbon atoms of a polyethyleneglycol having a molecular weight of from 200 to 600 or a polypropyleneglycol having a molecular weight of from 200 to 1,000 or mixtures thereof, (c) from 5 to 25 weight % of an amino-oxethylate of the formula

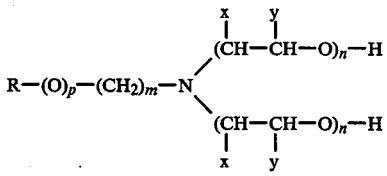

(IV)

in which $R_1$ is alkyl or alkenyl having from 8 to 22 carbon atoms, x and y are hydrogen or methyl, with the proviso that x and y are not simultaneously methyl, n is an integer of from 2 to 40, p is a number of from zero to 1, and m is a number of from zero to 3, with the provision that in case of p being 1 m is 1–3, and water up to 100%.

2. Concentrated masterbatches as claimed in claim 1, which substantially comprise from 35 to 45 weight % of component (a), from 40 to 60 weight % of component (b) and from 5 to 20 weight % of component (c), and water up to 100%.

3. Concentrated masterbatches as claimed in claim 1, wherein:

component (a) comprises 20–70 weight percent of a compound of the formula I to III, in which $R_1$ is alkyl or alkenyl having 10 to 18 carbon atoms and $R_2$ is methyl, component (b) comprises 20–60 weight percent of a paraffin, a fatty alcohol, a fatty acid, a fatty acid -$C_1$–$C_{13}$-alkyl ester, each having 16 to 18 carbon atoms, a polyethyleneglycol having a molecular weight of from 200 to 600, an alkyl ester having 14 to 16 carbon atoms of a polyethyleneglycol having a molecular weight of from 200 to 600 or a polypropyleneglycol having a molecular weight of from 200 to 1000 or mixtures thereof, and component (c) comprises a said amino-oxethylate of formula IV, in which R is alkyl or alkenyl having 16 to 18 carbon atoms, n is 10, and when p is 1, m is 3; all other terms in formulae I through IV being as defined in claim 1.

4. Concentrated masterbatches as claimed in claim 1, wherein, in formula IV, p is zero.

* * * * *